US009057167B1

(12) United States Patent
Ueng

(10) Patent No.: US 9,057,167 B1
(45) Date of Patent: Jun. 16, 2015

(54) PET DUNG COLLECTOR

(71) Applicant: Mei-Sheng Ueng, Taipei (TW)

(72) Inventor: Mei-Sheng Ueng, Taipei (TW)

( * ) Notice: Subject to any disclaimer, the term of this patent is extended or adjusted under 35 U.S.C. 154(b) by 0 days.

(21) Appl. No.: 14/340,570

(22) Filed: Jul. 25, 2014

(51) Int. Cl.
*A01K 29/00* (2006.01)
*E01H 1/12* (2006.01)

(52) U.S. Cl.
CPC ..... *E01H 1/1206* (2013.01)

(58) Field of Classification Search
CPC ..... E01H 1/1206
USPC ..... 294/1.3–1.5, 176, 179, 57, 59; 119/161, 119/867; 248/99, 101; 15/257.1; 43/4
See application file for complete search history.

(56) References Cited

U.S. PATENT DOCUMENTS

| | | | | |
|---|---|---|---|---|
| 4,222,597 | A * | 9/1980 | Willis | 294/1.4 |
| 4,477,111 | A * | 10/1984 | Crooks | 294/1.4 |
| 6,485,073 | B2 * | 11/2002 | Harrison | 294/1.4 |
| 8,511,728 | B2 * | 8/2013 | Beaton | 294/1.4 |
| 8,684,429 | B1 * | 4/2014 | Holub | 294/1.4 |
| 2009/0293337 | A1 * | 12/2009 | Arita et al. | 43/8 |
| 2013/0249224 | A1 * | 9/2013 | Ng | 294/1.4 |

* cited by examiner

*Primary Examiner* — Stephen Vu
(74) *Attorney, Agent, or Firm* — Leong C. Lei

(57) ABSTRACT

A pet dung collector includes a shovel, which consists of a handle, a shovel plate positioned at a front end thereof and a drop-in opening provided at the shovel plate whereas both sides thereof are provided with a respective hook, and a receipt component, which is pivotally connected at a bottom of the shovel plate and clipped beneath the drop-in opening as well as consists of a receiver for covering the drop-in opening when not in operation and receiving the dung therefrom. Thereby the hooks at both sides of the shovel plate are utilized to enable the shovel to extend over an edge of two surfaces with respect to each other of a collecting bag that by flipping the receipt component downward the dung can be automatically dislodged therefrom into the collecting bag.

6 Claims, 6 Drawing Sheets

PET DUNG COLLECTOR

(a) TECHNICAL FIELD OF THE INVENTION

The present invention is related to a pet dung collector, particularly a pet dung collector having a receipt component, as pivotally connected to an underside of a shovel plate, flipped downward for automatically discharging the dung therein.

(b) DESCRIPTION OF THE PRIOR ART

Metropolitan district usually has big population within a limited area such that the environmental hygiene is a focus. Cleaning dung discharged by a pet outdoors becomes a necessary task for a pet owner in order to keep the environment clean. Currently an ordinary pet owner carries a cleaning bag when walks a god that the owner can insert a hand into the cleaning bag, use the hand therein to pick up the dung discharged by the dog and then reverse the cleaning bag inside-out for retrieving the hand and packing the dung.

However the owner will contact the dung with just a thin layer of cleaning bag in between during the aforesaid action that may not be welcome by some pet owners. Therefore some pet owners are not willing to do such cleaning action and let the pets discharge dung along streets that causes environmental hygiene problems and hence demands an improvement.

The inventor of the present invention disclosed two inventions, Taiwan patent publication number 371831 and 563403, the cleaning devices for the pet owner to easily pick up the pet's dung and dislodge it into a collecting bag. However the pet owner cannot use the same collecting bag as once using it when the pet discharges again. Further the collecting bag cannot be stored after use that currently the pet owner will use a large collecting bag for collecting pet's dung when going outdoors for a long period of time. The cleaning devices of the prior art cannot be fixed to the large collecting bag so that the pet owner could easily let the dung fall off the shovel from one side so as to contaminate the edge of the large collecting bag resulting in both trouble and inconvenience in use. Therefore there is a demand for improvement.

SUMMARY OF THE INVENTION

An objective of the present invention is to provide a pet dung collector that includes a shovel, which consists of a handle, a shovel positioned at a front end thereof and a drop-in opening provided at the shovel plate whereas each of both sides of the shovel plate is provided with a hook, and a receipt component, which is pivotally connected at a bottom of the shovel plate and clipped beneath the drop-in opening as well as consists of a receiver for covering the drop-in opening when not in operation and receiving the dung passing through the drop-in opening. Thereby the hooks at both sides of the shovel plate are utilized to enable the shovel to extend over an edge of two surfaces with respect to each other of a collecting bag that the dung can be automatically dislodged from the receipt component into the collecting bag by flipping the receipt component downward.

DETAILED DESCRIPTION OF THE PREFERRED EMBODIMENTS

Figure 1:
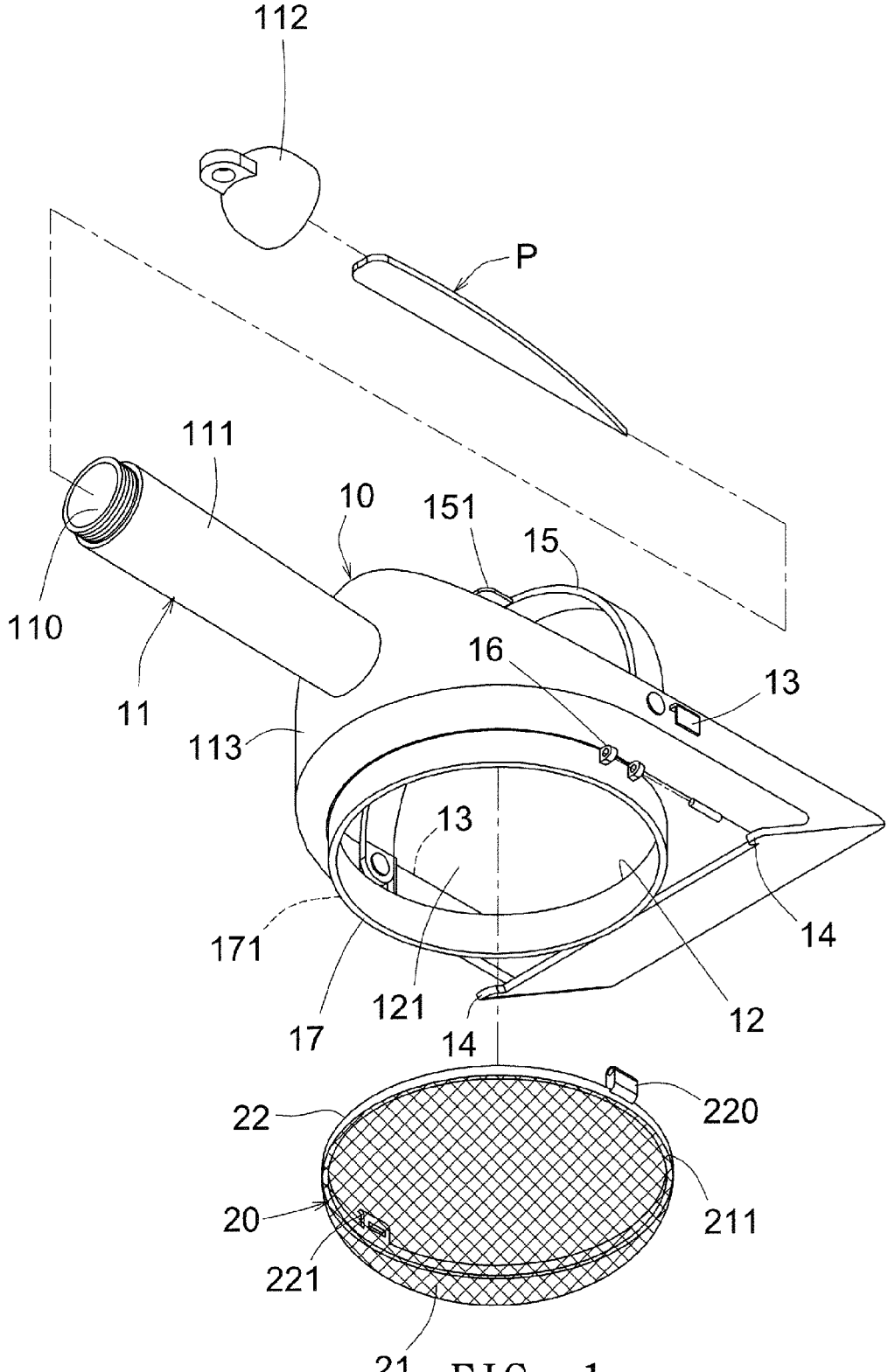
FIG. 1 is a perspective view illustrating a three-dimensional disassembly diagram of the present invention.
Figure 2:
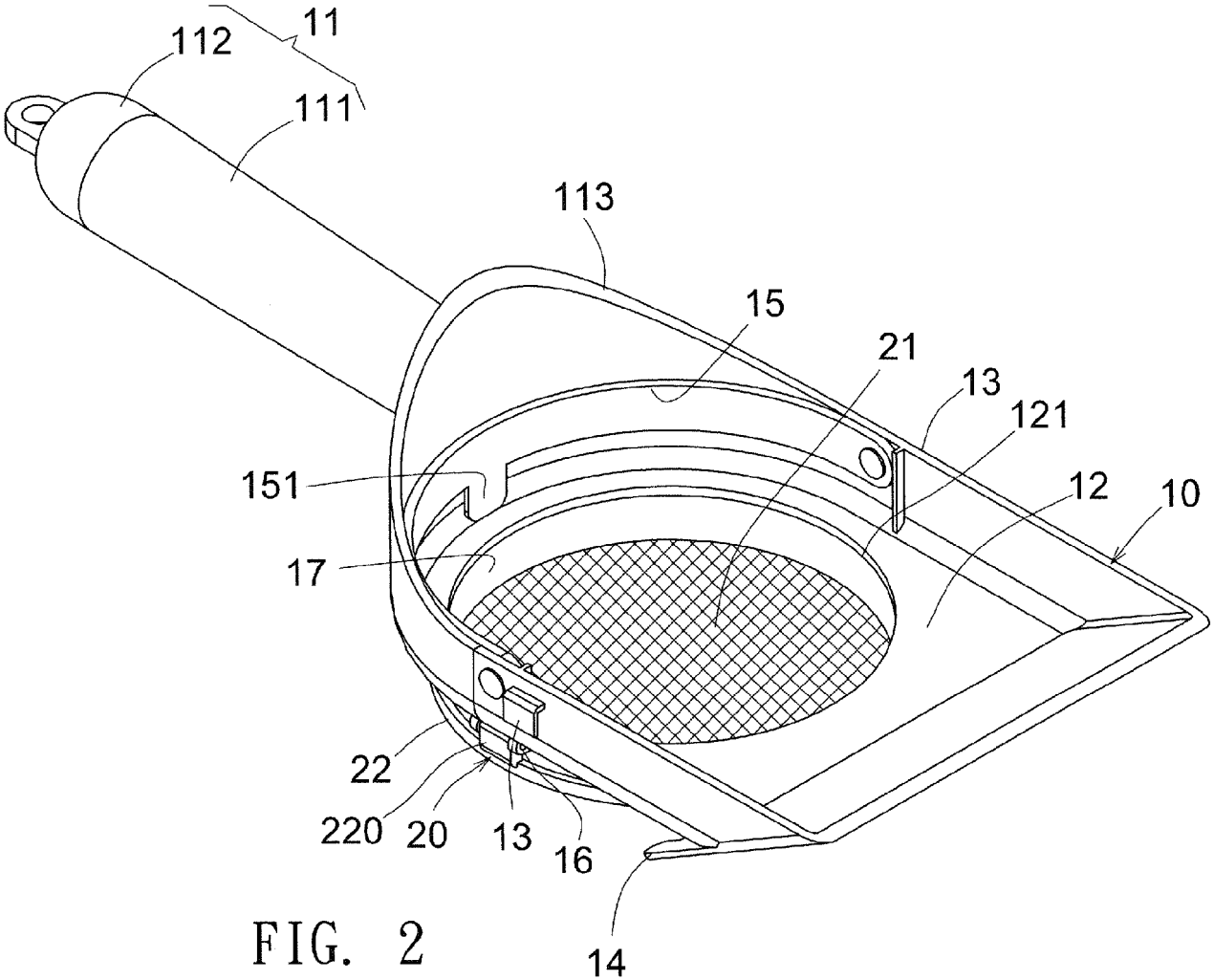
FIG. 2 is a perspective view illustrating a three-dimensional assembly diagram of the present invention.

Please refer FIG. 1 to FIG. 6 illustrating a pet dung collector of the present invention that includes a shovel (10) consisting of a handle (11), a shovel plate (12), which is positioned at a front end of the handle (11), and a drop-in opening (121), which is provided at the shovel plate (12), whereas each of both sides of the shovel plate (12) is provided with a hook (13), and a receipt component (20), which is pivotally connected at a bottom of the shovel plate (12) and clipped beneath the drop-in opening (121) as well as consists of a receiver (21) for covering the drop-in opening (121) when not in operation and receiving the dung passing through the drop-in opening (121). Thus the hooks (13) positioned at both sides of the shovel plate (12) are utilized to enable the shovel (10) to extend over an edge (31) of two surfaces with respect to each other of a collecting bag (30) that the dung can be automatically dislodged from either the receiver (21) or the shovel plate (12) into the collecting bag (30) by flipping the receiver (21) of the receipt component (20) downward.

Figure 4:
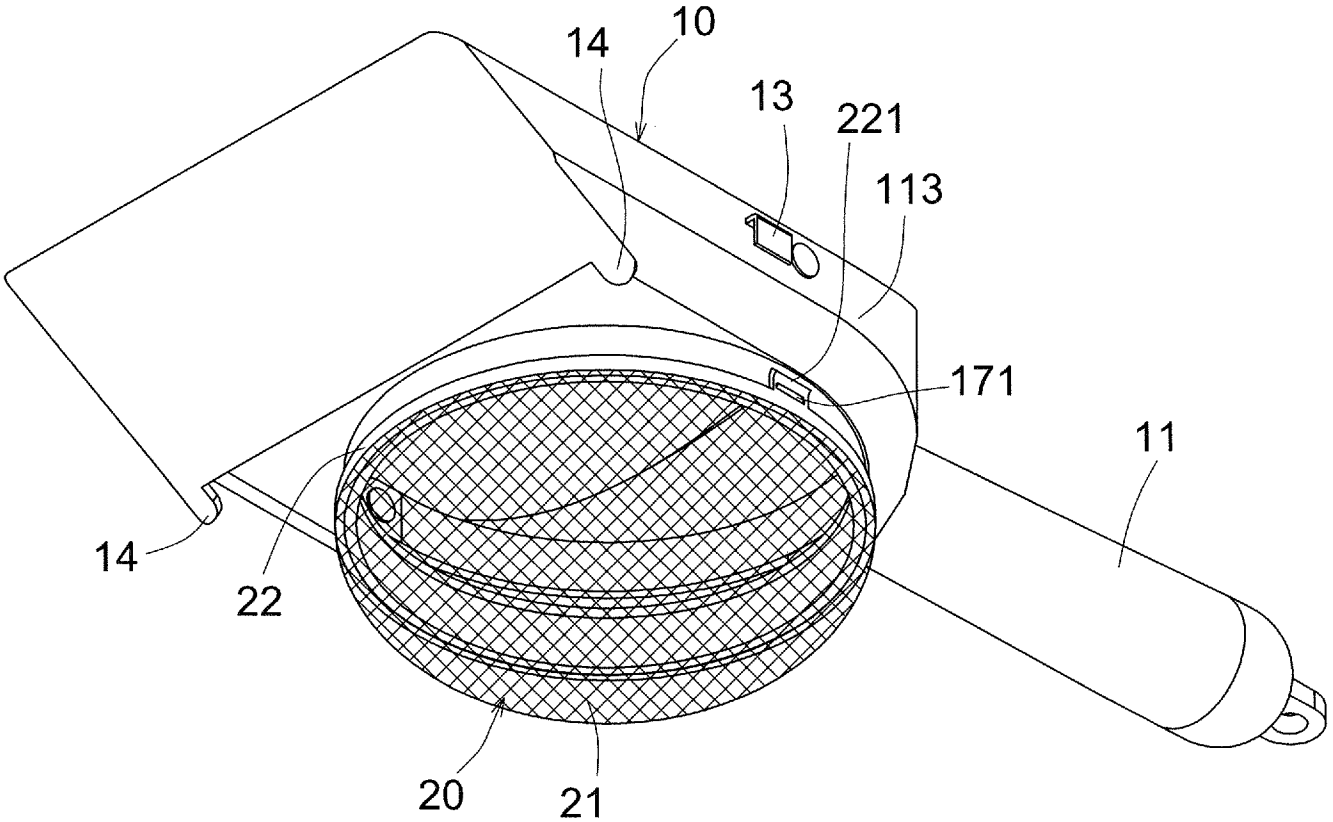
FIG. 4 is a three-dimensional diagram of FIG. 3 rotating 180 degrees.

As shown in FIGS. 1 and 4, the pet dung collector of the present invention includes a handle (11) consisting of a body (111) while a compartment (110) is inwardly configured from an outer end of the body (111) for storing a tools such as a scraper, clip or the like and a lid (112) is provided at the outer end of the body (111) by screw or socket in order to prevent the aforesaid tools from falling out.

The shovel (10) of the pet dung collector of the present invention further includes a stopper (113), which is positioned at both sides and a rear edge of the shovel plate (12) in a radial direction in a protruding form, in order to prevent the dung, which is already picked up, from falling off either one side or the rear edge of the shovel plate (12).

As shown in FIGS. 1, 2, 3 and 4, the pet dung collector of the present invention includes an under-hook (14), which is respectively provided at both sides of a bottom of the shovel plate (12), a hanger (15), which is pivotally provided between both sides of the shovel (10), and an upper-hook (151), which is provided at the hanger (15). Thereby, with the two under-hooks (14) underneath the shovel plate (12) and the upper-hook (151) at the hanger (15), the user can stably hang a collecting bag after flipping the hanger (15) that the collecting bag is connected to a fore-end of the shovel plate (12) in a tripod manner. Therefore the user can dislodge the dung already picked up by the shovel (10) through its front end into the hang collecting bag and then release it from the shovel (10) after cleaning action.

Further the receiver (21) of the receipt component (20) is in a solid plate format or a net format. As shown in FIGS. 1, 2, 3 and 4, a ring (22) is provided to a top circumference (211) of the receiver (21) in the net format that an ear (220) is provided at the ring (22) to be pivotally connected with an underside of the shovel (10) while a protrusive part (221) is provided at a periphery of the ring (22) for clipping to a corresponding positioning piece (171), which is located at the underside of the shovel (10), so as to secure the ring (22) to a circumference underneath the drop-in opening (121) and cover it by the receiver (21) in the net format.

Figure 3:
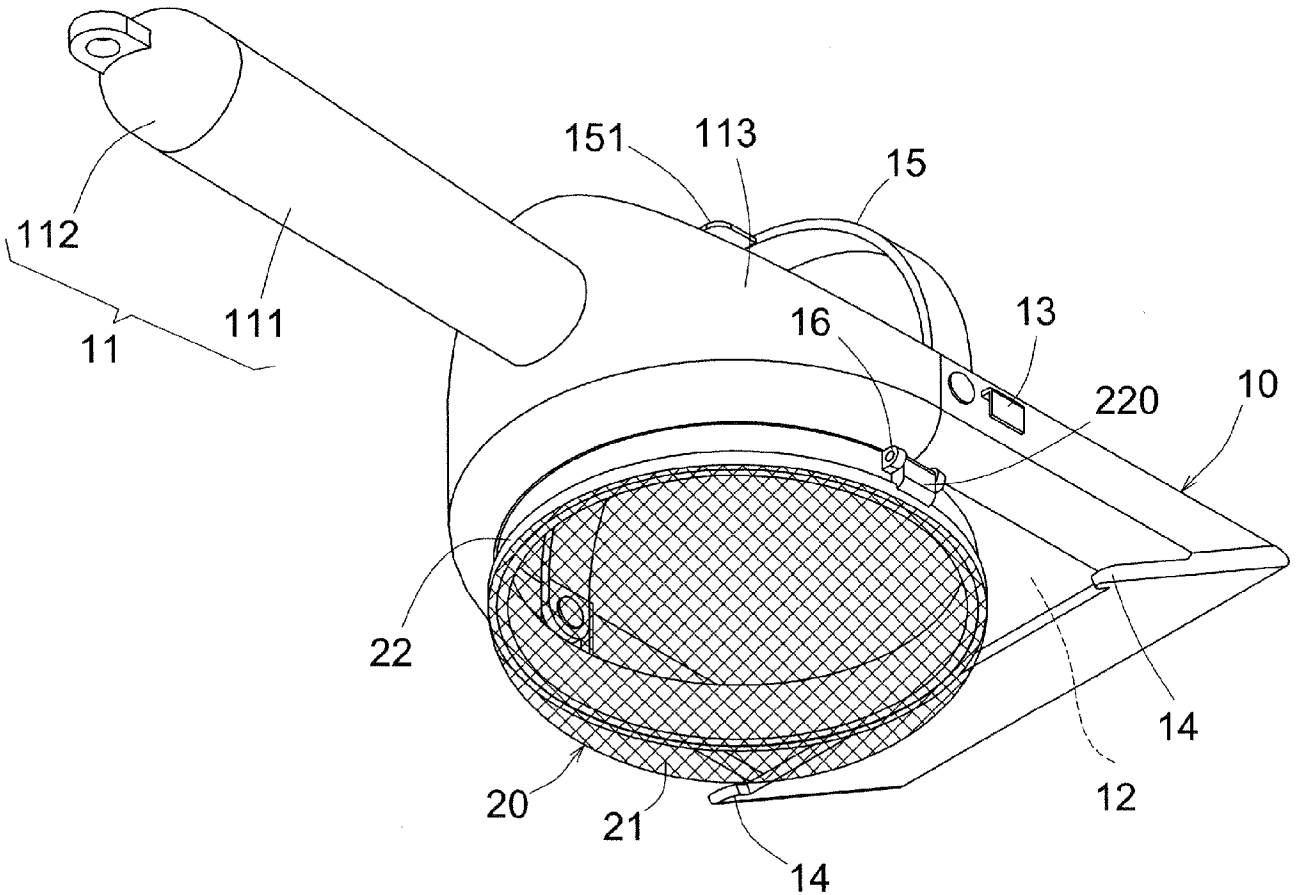
FIG. 3 is a three-dimensional diagram looking up toward a bottom of the present invention.

As shown in FIGS. 3 and 4, the underside of the shovel (10) is provided with a pivot stand (16), which is to pivotally connect to the ear (220) at the ring (22) of the receipt component (20), while a bottom of the drop-in opening (121) is provided with a protruding circle (17), at which's an outer periphery a positioning element (171) is provided, that the ring (22) is rotably connected the protruding circle (17) in accordance with the pivot stand (16). Moreover, the protrusive part (221) of the ring (22) can be engaged to the positioning element (171) so as to secure the receipt component (20) underneath the drop-in opening (121).

Figure 5:
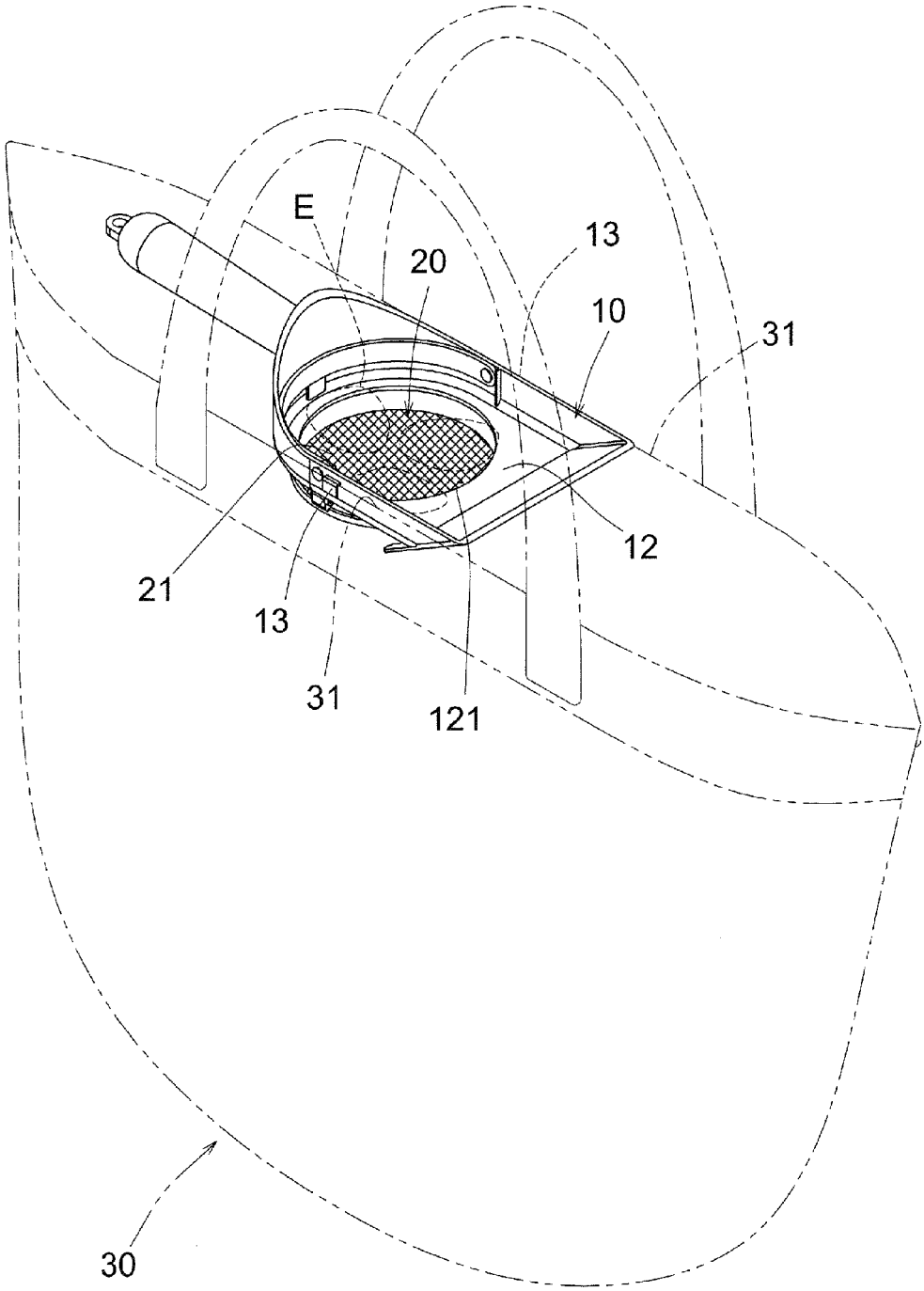
FIG. 5 is a schematic diagram illustrating an embodiment extended over a collecting bag of the present invention.
Figure 6:
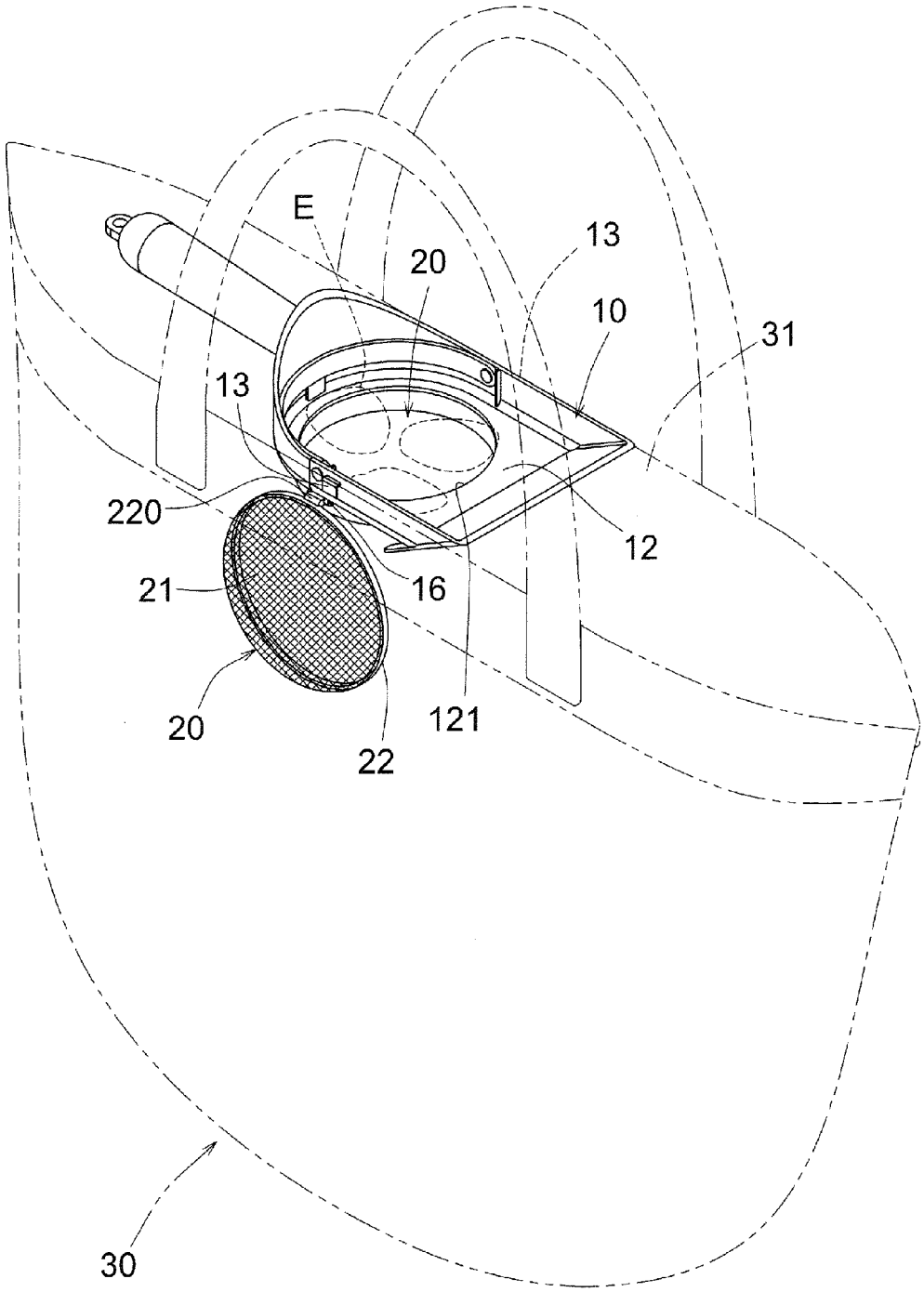
FIG. 6 is a schematic diagram illustrating FIG. 5 during operation with a receipt component flipped downward.

As shown in FIGS. 3 and 5, the hooks (13) positioned at both sides of the shovel plate (12) is in an inverted L shape and located at an outer side with respect to the stopper (113). When the user places the present invention over an upper side of the large collecting bag (30), the edge (31) of two surfaces with respect to each other can be held between the stoppers (113) and the hooks (13) such that the shovel (10) can firmly extend an inlet of the collecting bag (30) and stably extend the shovel (10) over and above the inlet of the collecting bag (30). Then the user can flip the receipt component (20) downward as shown in FIGS. 5 and 6 that the dung (E) at the receiver (21) of the receipt component (20) will exactly fall into the collecting bag (30) through the drop-in opening (121) from the shovel plate (12) without falling out of the collecting bag (30) and contaminating it or even embarrassing falling to the ground.

I claim:

1. A pet dung collector comprising:

a shovel consisting of a handle, a shovel plate as positioned at a front end of the handle and provided with a drop-in opening, and a hook located at each of both sides of the shovel plate; and a receipt component consisting of a receiver and being pivotally connected to an underside of the shovel plate and clipped beneath the drop-in opening for receiving a dung therefrom;

wherein the handle of said shovel includes a body having an outer end that is provided with an inward compartment and a lid;

whereby the hooks located at both sides of the shovel plate are utilized to enable said shovel to extend over an edge of two surfaces with respect to each other of a collecting bag for automatically dislodging the dung from said receipt component or the shovel plate into the collecting bag by flipping the receiver of said receipt component downward.

2. The pet dung collector of claim 1, wherein the lid is secured to the outer end of the body by screw or socket.

3. The pet dung collector of claim 1 wherein the receiver of said receipt compartment is in a net format with a top circumference connected with a ring that is provided with an ear to be pivotally connected with a underside of said shovel and a protrusive part at a periphery of the ring for clipping to a corresponding positioning piece located at the underside of said shovel so as to secure the ring to a circumference underneath the drop-in opening and cover it by the receiver in the net format.

4. The pet dung collector of claim 1, wherein the underside of said shovel is provided with a pivot stand for pivotally connecting said receipt component while a bottom of the drop-in opening is provided with a protruding circle that an outer periphery thereof is provided with a positioning element.

5. The pet dung collector of claim 1, wherein the hooks positioned at both sides of the shovel plate is in an inverted L shape.

6. The pet dung collector of claim 1 wherein the receiver of said receipt component is in a solid plate shape.

* * * * *